United States Patent [19]

Tecl et al.

[11] 4,154,885

[45] May 15, 1979

[54] NONWOVEN FABRIC OF GOOD DRAPING QUALITIES AND METHOD OF MANUFACTURING SAME

[75] Inventors: Bohuslav Tecl; Adolf Graber; Erich Fahrbach, all of Weinheim, Fed. Rep. of Germany

[73] Assignee: Firma Carl Freudenberg, Weinheim, Fed. Rep. of Germany

[21] Appl. No.: 809,493

[22] Filed: Jun. 23, 1977

[51] Int. Cl.[2] ..... B32B 3/10

[52] U.S. Cl. ..... 428/198; 156/181; 156/305; 156/306; 428/288

[58] Field of Search ..... 428/198, 288, 296, 359, 428/360, 362, 113, 152; 156/181, 305, 306

[56] References Cited

U.S. PATENT DOCUMENTS

| | | | |
|---|---|---|---|
| 2,880,112 | 3/1959 | Drelich | 428/532 |
| 2,880,113 | 3/1959 | Drelich | 428/532 |
| 3,855,045 | 12/1974 | Brock | 428/198 |
| 3,855,046 | 12/1974 | Hansen | 428/198 |
| 3,949,127 | 4/1976 | Ostermeier | 428/296 |
| 3,949,128 | 4/1976 | Ostermeier | 428/152 |

*Primary Examiner*—Marion E. McCamish
*Attorney, Agent, or Firm*—Sprung, Felfe, Horn, Lynch & Kramer

[57] ABSTRACT

A fibrous nonwoven fabric of good drapability, comprising geometrically arranged spaced first surface areas of about 0.02 to 0.2 $mm^2$ in area in which its fibers are chemically or thermally bonded at their intersections, and second area whose junctions are at least partially reopened and in which the bond points are disposed closely adjacent one another is produced by bonding a non-woven fleece chemically or thermally, and then stretching the resulting fabric at spaced areas so as to expand it partially and form areas where the fibers are less or not bonded. Where a chemical binder is used it may be set only partially prior to stretching, setting being completed thereafter.

9 Claims, 4 Drawing Figures

NONWOVEN FABRIC OF GOOD DRAPING QUALITIES AND METHOD OF MANUFACTURING SAME

BACKGROUND

The invention relates to a nonwoven fabric having good draping qualities and to a process for the manufacture thereof.

An important quality involved in judging the textile characteristics of a nonwoven fabric is its draping characteristic. This characteristic is measurable, and depends to a great extent on the percentage content of the binding agent in the fabric. In general, the higher the binding agent content is, the poorer the draping qualities will be. Reducing the binding agent content results in an improvement of the draping qualities, yet generally it is accompanied by a reduction in the strength of the fabric.

In the effort to overcome these contrary factors and to expand the application of nonwovens to the field of decorative materials by providing them with good draping quality combined with good strength, recourse has been taken to mechanical apparatus, such as breakers, decatizers, or calendars. In this manner improvements have been obtained with regard to the draping quality achieved, but new, undesirable side-effects were produced in the form of a loss of thickness, leafiness, and difficulties with regard to wrinkle-resistance in the fabric, and showed that such procedures had only partially solved the problem.

Recently a system has become known in which nonwovens are bonded by a partial imprinting of the fabrics with the binding agent in a geometrical pattern, for example. This, however resulted in the disadvantage that it is not possible by the methods of the printing art to make the binding spots as small as one might desire. Consequently, the finished fabric was a material which consisted in a succession of strongly bound and unbound areas, which considerably limited its application. Particularly in the field of decorative materials, this kind of bonded nonwovens is impractical.

THE INVENTION

The invention is addressed to the problem of developing a nonwoven fabric having a homogeneous structure and having good draping qualities combined with good strength characteristics.

This problem is solved by a nonwoven fabric which has, in a geometrical arrangement, surface areas of about 0.02 to 0.2 $mm^2$, and preferably of about 0.05 to 0.1 $mm^2$, in which its fibers are bonded chemically or thermally at their intersections, and which has between the areas, in addition to unbonded areas if desired, areas in which the junctions are at least partially reopened, and in which the junction areas are arranged closely adjacent one another.

It has proven especially desirable if the sum of the area covered by the surfaces of undisturbed junctions occupies from about 2 to 20% of the fabric, preferably about 5 to 10%, and if the junction areas are disposed at a distance of about 0.5 to 4 mm apart, preferably at a distance of about 0.8 to 2 mm apart. For the production of a nonwoven fabric bonded in this manner it has proven desirable first to bond it continuously or in patterns either thermally or with a binding agent, and then to reopen a portion of the junctions by overstretching with known hydraulic or mechanically operated apparatus, doing so in such a manner that undamaged and open or free junctions will be located beside one another in very small areas. If in the performance of this process a chemically acting binding agent is used, it has been found desirable first to impregnate the fabric with the chemically acting binding agent and dry it, then to reopen a portion of the junctions produced by overstretching them in small areas, and thereafter to complete the condensation of the binding agent. It has proven to be especially expedient, for the opening of the junctions, to pass the mat through a squeezing mechanism, which can be heated if desired, and which is composed of a brush roller or an engraved roller of metal and a counter-roll of rubber, such mechanism being so constructed and adjusted that the elevations of the metal roll compress the mat and fix it during its passage through the nip, and that the areas of the mat between these elevations are overstretched by the yielding rubber of the counter-roller.

The process described above is largely susceptible of modification. By a relatively easy-to-make selection as regards the hardness of the rubber-elastic roller and with regard to the length and the shape of the elevations arranged on the metal roll, and as regards the force with which the two rollers engage one another, the process of the invention can be applied to the improvement of the draping qualities of virtually all known bonded nonwovens.

The invention can be further understood by reference to the accompanying drawing wherein.

EXAMPLES

Figure 1:
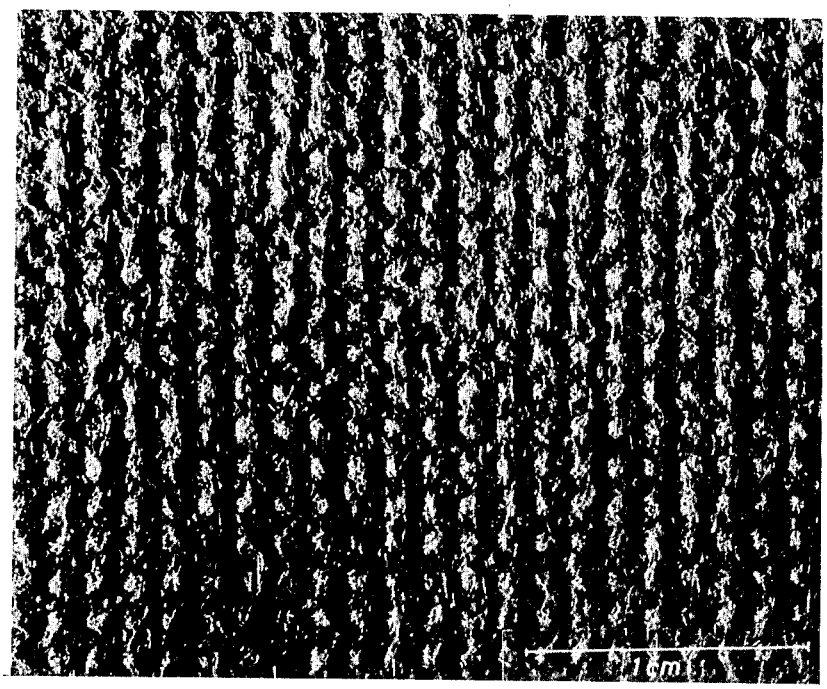
FIG. 1 is a 5-fold photomicrograph of the top of a fabric produced in accordance with the present invention.
Figure 2:
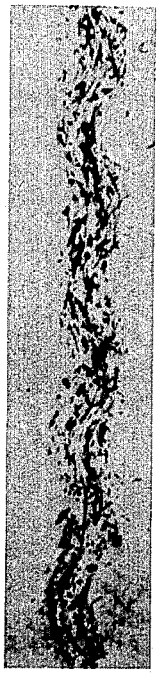
FIG. 2 is a 20-fold photomicrograph of the product as viewed from the right of FIG. 1.
Figure 3:
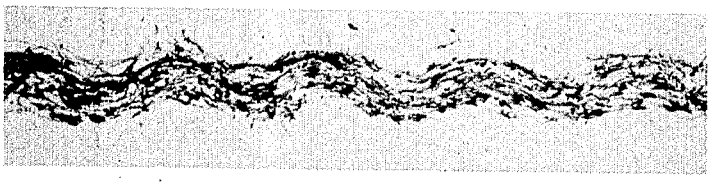
FIG. 3 is a 20-fold photomicrograph of the product as viewed from the bottom of FIG. 1.
Figure 4:
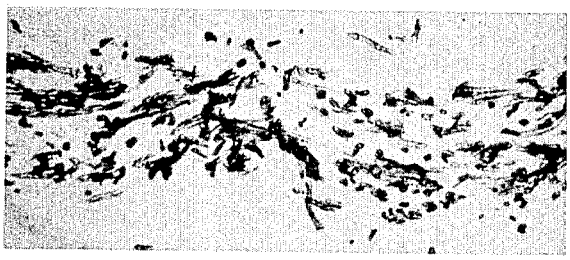
FIG. 4 is a 50-fold photomicrograph of the product along a vertical section through it.

In the following table a comparison is made of a number of nonwoven fabrics which were treated by the process of the invention, wherein an engraved metal cylinder was used having the following characteristics:

Diameter: 150 mm
Engraving depth: 0.65 mm
Number of points: 64 per $cm^2$
Point contact surface size: 0.3×0.3 mm
Relative compression surface: 5.75%
Flank angle of point: 30°

Operating parameters were established within the following ranges:

Steel cylinder temperature: 150° to 170° C.
Resilient roller temperature: 130° to 180° C.
Linear pressure of rollers: 40 to 75 kg/cm
Linear speed: 4 to 15 m/min.
Resilient roller hardness: 40 to 70 Shore A Nonwoven fabrics were produced as follows:

EXAMPLE 1

A wet nonwoven consisting of 60 parts of viscose fibers and 40 parts of cotton dust, bonded with an acrylic binder aqueous suspension having a solids content of 40% and dried. Per 77 parts by weight of fiber, the fabric contained 33 parts of binder of the following composition by weight:

butadiene-acrylonitrile: 90 acrylonitrile: 5
methacrylic acid: 2
N-methylol-acrylamide: 3

EXAMPLE 2

A longitudinally oriented nonwoven fleece consisting of 90 parts of 40 mm cellulose staple fibers of 1.7 dtex and 10 parts of 51 mm PVA staple fibers of 3.7 dtex, having a specific weight of 55 g/m$^2$, shrunk in water at 80° C. and then dried at 150° C. The total area shrinkage amounted to 30%. The fabric had a final weight of approximately 110 g/m$^2$ after being imprinted in a checkered pattern with an acrylic binding agent in the proportions and of the composition according to Example 1.

EXAMPLE 3

Cross-laid fabric consisting of 40 parts of 60 mm bright nylon staple fibers of 3.3 dtex, 40 parts of 40 mm dull nylon staple fibers of 1.7 dtex and 20 parts of 40 mm bright viscose staple fibers of 1.4 dtex, impregnated with a latex base foam binding agent, dried, and fully condensed by heating for 4 minutes at 180° C. Per 85 parts of weight of fiber there were employed 15 by weight of binder solids which comprised, by weight, butadiene-acrylonitrile: 65
acrylonitrile: 31
N-methylol-acrylamide: 4 the binder being applied as a 40% suspension in water.

EXAMPLE 4

Fabric from Example 3, in which, however, the condensation of the binding agent was not performed until after the fabric had been treated by the method of the invention.

EXAMPLE 5

Spun mat consisting of polyamide 6 and bonded by impregnation with an acrylic binding agent according to Example 1.

TABLE

| | | EXAMPLE | | | | | | | | |
|---|---|---|---|---|---|---|---|---|---|---|
| | | 1 | | 2 | | 3 | | 4 | 5 | |
| | | Before treat. | After treat. | Before treat. | After treat. | Before treat. | After treat. | Condensed after softening | Before treat. | After treat. |
| Hoechst Traction Force, DIN 53857/2 (N) | Length | 50 | 42 | 87 | 68 | 99 | 87 | 76 | 99 | 101 |
| | Width | 35 | 28 | 7 | 6 | 30 | 32 | 23 | 91 | 99 |
| Hoechst Traction Force, % | Length | 9 | 11 | 12 | 17 | 33 | 35 | 29 | 68 | 68 |
| | Width | 14 | 16 | 86 | 61 | 74 | 83 | 63 | 74 | 73 |
| Specific weight, g/m$^2$ | | 72 | 70 | 49 | 50 | 49 | 51 | 49 | 57 | 59 |
| Thickness, mm DIN 53855/1 | | 0.46 | 0.45 | 0.35 | 0.47 | 0.44 | 0.50 | 0.40 | 0.54 | 0.52 |
| Drapability Coefficient, % (Cusick Drape Test) | | 78 | 47 | 70 | 45 | 76 | 54 | 48 | 62 | 55 |

As can be seen clearly from the foregoing table, the strength-related properties of the nonwoven fabrics treated by the method of the invention are only slightly affected, whereas their draping quality, expressed by the fall coefficients, is improved to an especially high degree. This finding is of great importance especially because the binding agent spots remaining in the finished fabric can be made so small, without any further difficulty, that they are scarcely perceptible to the naked eye, or at least are not disturbingly apparent, for example when they are distributed over the fabric in a weave-like structure. Nonwoven fabrics treated accordingly can consequently be made in a wide variety of structures from the aesthetic point of view. Since they have excellent draping qualities combined with good strength, they are consequently susceptible of new applications, even in fields which hitherto have been closed to nonwoven fabrics.

It will be appreciated that the instant specification and examples are set forth by way of illustration and not limitation, and that various modifications and changes may be made without departing from the spirit and scope of the present invention.

What is claimed is:

1. A process for the manufacture of a nonwoven fabric of good drapability, comprising bonding a nonwoven fibrous fleece with a binding agent or thermally, and thereafter stretching the bonded fabric at spaced areas beyond its yield so that a portion of the junctions is reopened between other areas of about 0.02 to 0.2 mm$^2$ spaced about 0.5 to 4 mm from one another which other areas are still bonded and substantially unchanged, the fabric undergoing substantially no loss in bulk during stretching.

2. A fibrous nonwoven fabric of good drapability, comprising geometrically arranged spaced first surface areas of about 0.02 to 0.2 mm$^2$ in area in which its fibers are chemically or thermally bonded at their intersections, and second areas whose junctions are at least partially reopened and in which the bond points are disposed about 0.5 to 4 mm from one another, and produced by the process of claim 1.

3. A process according to claim 1, wherein the first areas occupy from about 2 to 20% of the fabric surface.

4. A process according to claim 1, wherein the first areas are chemically bonded, occupy from about 5 to 10% of the fabric surface and are about 0.8 to 2 mm from one another, the first areas varying in area from about 0.05 to 0.1 mm$^2$.

5. A process for the manufacture of a nonwoven fabric according to claim 1, wherein the bonding of the fleece is effected in spaced areas leaving unbonded areas, the stretched end product containing areas free of binding.

6. A process for the manufacture of a nonwoven fabric according to claim 1, wherein bonding is effected overall with a chemically acting binding agent.

7. A process for the manufacture of a nonwoven fabric according to claim 1, wherein stretching is effected by passage of the fabric through the heated nip of a yielding roll and an unyielding roll having elevated areas of about 0.02 to 0.2 mm$^2$ spaced about 0.5 to 4 mm from one another, the rolls bearing against one another so as to effect stretching only in the zones between the elevations of the unyielding roll, holding of the fabric between the elevations and yielding roll preventing stretching at the held areas.

8. A process for the manufacture of a nonwoven fabric according to claim 7, wherein bonding is effected with a chemically acting binding agent which undergoes setting but setting is effected only partially prior to stretching, setting being completed after stretching.

9. A process for the manufacture of a nonwoven fabric according to claim 7, wherein the amount of stretching between the elevations of the unyielding roll corresponds to that obtained by pressing an unyielding roll having elevated areas 0.65 mm high with a pressure of 40 to 75 kg/cm against a yielding roll of 40 to 70 Shore A hardness.

* * * * *